United States Patent [19]

Rollmann et al.

[11] 4,233,138

[45] Nov. 11, 1980

[54] PROCESS FOR THE VISBREAKING OF HIGH-METALS CRUDES AND RESIDS

[75] Inventors: Louis D. Rollmann, Princeton, N.J.; Dennis E. Walsh, Richboro, Pa.

[73] Assignee: Mobil Oil Corporation, New York, N.Y.

[21] Appl. No.: 5,428

[22] Filed: Jan. 22, 1979

[51] Int. Cl.[3] ..... C10G 9/00

[52] U.S. Cl. ..... 208/106; 208/48 AA; 208/125

[58] Field of Search ..... 208/48 AA, 106, 107, 208/125, 126, 57, 130

[56] References Cited

U.S. PATENT DOCUMENTS

| | | | |
|---|---|---|---|
| 1,478,102 | 12/1923 | Clark et al. | 208/106 |
| 2,526,966 | 10/1979 | Oberfell et al. | 208/57 |
| 3,321,395 | 5/1967 | Paterson | 208/57 |
| 4,025,051 | 5/1977 | Shell et al. | 208/48 AA |

FOREIGN PATENT DOCUMENTS

| | | | |
|---|---|---|---|
| 133570 | 10/1979 | German Democratic Rep. | 208/48 AA |

OTHER PUBLICATIONS

Nelson, "Petroleum Refinery Engineering", Fourth Edition, 1958 pp. 92 & 94.

*Primary Examiner*—Herbert Levine
*Attorney, Agent, or Firm*—Charles A. Huggett; Raymond W. Barclay

[57] ABSTRACT

A process for suppressing the coking tendency of heavy crudes and resids in visbreaking operations comprising treating the charge stock with an inorganic sulfide.

7 Claims, 1 Drawing Figure

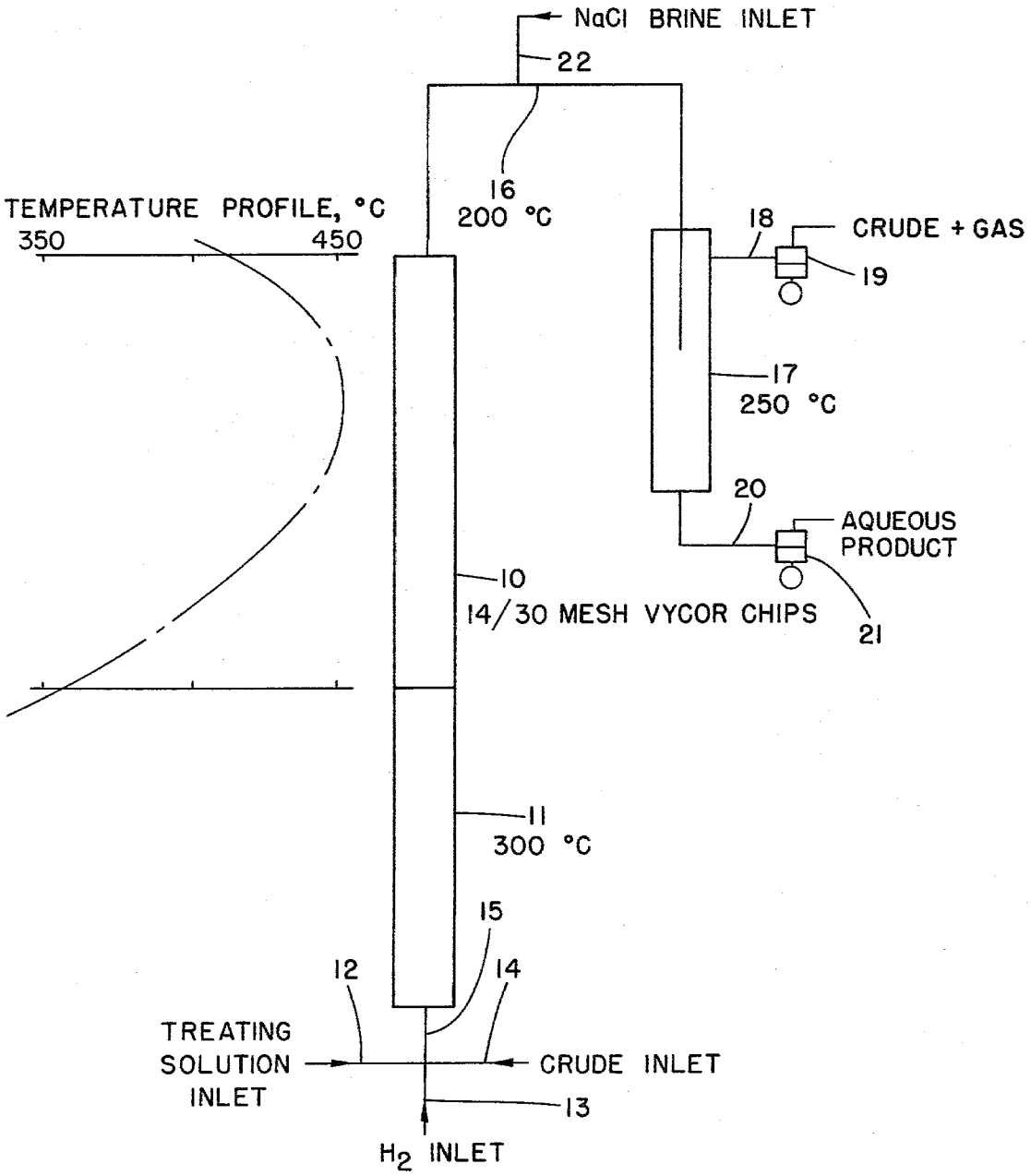
NaCl BRINE INLET
22
16
200 °C
TEMPERATURE PROFILE, °C
350
450
18
CRUDE + GAS
19
17
250 °C
20
AQUEOUS
PRODUCT
10
14/30 MESH VYCOR CHIPS
21
11
300 °C
15
12
14
TREATING
SOLUTION
INLET
CRUDE INLET
13
H2 INLET

PROCESS FOR THE VISBREAKING OF HIGH-METALS CRUDES AND RESIDS

BACKGROUND OF THE INVENTION

1. Field of the Invention

This invention relates to the processing of heavy crude and residual petroleum charge stocks, and in particular, relates to the visbreaking of such charge stocks containing significant quantities of metal values found to promote the formation of coke, notably, those of nickel and/or vanadium.

2. Description of the Prior Art

"Visbreaking", or viscosity breaking, is a well known petroleum refining process in which reduced crudes are pyrolyzed, or cracked, under comparatively mild conditions without significant coke production to provide products having lower viscosities and pour points thus reducing the amounts of less-viscous and more valuable blending oils required to make the residual stocks useful as fuel oils. In a typical visbreaking process, the crude or resid feed is passed through a heater and thereafter into a reaction chamber operating at from about 800° to about 975° F. and at about 50 to about 1000 psig. Light gas oil is injected to lower the temperature of the effluent to within about 830° to about 850° F. Cracked products from the reaction chamber are introduced to a flash distillation unit with the vapor overhead being separated in a fractionating column into a light distillate overhead product (i.e., gasoline) and light gas-oil bottoms, and the liquid bottoms being separated in a vacuum fractionating column into heavy gas-oil distillate and residual tar.

Heretofore, high-metals heavy charge stocks have been processed in coking or catalytic hydroprocessing operations. Visbreaking has achieved little importance with such crudes due to their tendency to produce significant quantities of coke which plugs the reactor, shortens production runs and results in unacceptably lengthy periods of down time.

It has now been observed that this tendency of high-metals crudes and resids to undergo coking during visbreaking is related to the presence of transition metal values therein, notably nickel and/or vanadium. Such metals can be removed under hydrodesulfurization conditions with frequent catalyst replacement, or in a specially designed cracking unit. However, it is desired to effect more direct treatment, advantageously in a visbreaking operation.

SUMMARY OF THE INVENTION

It has now been discovered that if the visbreaking of crude and resid feeds containing relatively high levels of metal values which promote the formation of coke is carried out in the presence of an inorganic sulfide capable of interacting with the coke promoting metal values, to effect their removal from the feed, the coke-forming tendencies of the feeds can be reduced with attendant increase in on-stream time.

Thus, in a particular visbreaking operation utilizing a Melones crude treated with 500 ppm Ni, hydrogen/methane ratios increased five-fold, coke yield more than doubled and product viscosity deteriorated markedly as compared with the treatment of the basic crude. When ammonium sulfide (0.5% S) was added to the original crude (90 ppm Ni, 400 ppm V) coke yields were almost halved. Investigation has shown that the use of an inorganic sulfide in a visbreaking process in accordance with this invention does not result in the introduction of any appreciable amounts of sulfur in the resulting products.

Thus, the process of this invention provides an economically attractive and technically feasible procedure for treating high-metals crudes and resids, particularly Venezuelan crudes, which heretofore have been processed by coking or catalytic hydroprocessing. Visbreaking in accordance with this invention can be carried out at a site which is removed from the wellhead, e.g., at a refinery, but can, if desired, be conveniently employed at or near the wellhead.

Among the inorganic sulfides which are advantageously employed herein are included one or more of the alkali metal sulfides, the alkaline earth metal sulfides, hydrogen sulfide, ammonium sulfide and other sulfides of similar reactivity with nickel and/or vanadium values present in crude and resid feeds. Of the foregoing, hydrogen sulfide, sodium sulfide and ammonium sulfide have been found to provide excellent results. As will be appreciated by those skilled in the art, the amount of inorganic sulfide employed will depend upon such factors as the amount of coke promoting metal values in the feed, the reactivity of the selected sulfide for such metal values, and the desired extent of demetalation. These factors can be readily determined for a particular set of conditions employing known and conventional techniques. In general, the amount of sulfide should be selected so as to minimize the formation of coke during the visbreaking operation.

In most cases, predicated upon the usage of a representative charge stock comprising about 100 ppm of nickel and about 400 ppm of vanadium (among other metal values in the usual proportions) the amount of sulfide employed to significantly suppress coking will range from about 0.05%, preferably at least 0.25–0.5%, up to 5% S. Charge stocks, however, may vary from 50 to 2000 ppm nickel, and while the desired sulfide level may be correlated with the transition metal content, it appears that the effect may not necessarily be stoichiometric. Accordingly, any sulfide levels effective in suppressing coking, whether by demetallizing or passivating the charge stock or by other unknown mechanisms are contemplated as within the scope of the invention.

Any charge stock having significant transition metal levels may be processed with advantage in the manner described. Thus, a charge stock containing 90 ppm Ni and 400 ppm V additionally treated with an aqueous feed containing 1000 ppm Ni has been successfully processed, extending on-stream time from 8 to 27+ hours. Concomitant results may be secured at intermediate or extended transition metal levels, having regard for the balance of metal values present, and their relative coking tendency.

The present invention is illustrated in an operation employing steam at (e.g., 100–2000 psig) to increase vapor velocities, thereby further suppressing coking. Water may similarly be injected, or hydrogen employed, although none of these expedients is essential to the process described.

Other conditions of the visbreaking process herein, i.e., flow rates of crude or resid feed, steam, hydrogen gas, working pressures and temperatures, and the like are well known parameters and can be optimized for the process herein in the usual manner.

BRIEF DESCRIPTION OF THE DRAWING

The attached FIGURE of drawing represents a schematic diagram of laboratory scale equipment employed in the process runs described below, the equipment comprising a continuous flow reactor with a high-temperature, high pressure separator on the effluent line.

DESCRIPTION OF THE PREFERRED EMBODIMENTS

In FIG. 1, vycor-packed reactor chamber 10 with 10 cc free volume and having a preheater section 11 internally heated to 300° C. is fed with aqueous treating solution through line 12, hydrogen gas through line 13 and crude petroleum (Melones, containing 90 ppm Ni, 400 ppm V, and 3.94% S) at 120° C. through line 14 converging through line 15 into the base of the preheater. The temperature profile of the reactor chamber throughout its length is as shown in the temperature profile curve adjacent the chamber. Pressure is 1000 psig. Reaction effluent at 200° C. leaving reactor chamber 10 through line 16 is introduced to high pressure separator 17 operated at an internal temperature of 250° C. (1000 psig) which separates the reaction products into crude and a gaseous product which is discharged from the separator through line 18 and collected in recovery unit 19, and an aqueous product which is discharged from the separator through line 20 and collected in recovery unit 21. Na Cl brine is introduced into line 16 through line 22.

In the runs whose results are given in the data below, flow rates averaged 60 cc/hr. for the aqueous treating solution, 80 cc/hr. for the crude and 50 cc brine (20% Na Cl). The temperature profile shown in the attached schematic diagram was held constant to the extent possible (300° C. preheater, 447° C. center of bed, 449° C. outlet) in order to avoid any thermal reactions in the preheater section or in the initial section of the reactor chamber. When the reactor chamber plugged, the solid coke was generally found in the upper half thereof.

Liquids were analyzed for Ni, V, S and N after centrifuging to remove any residual water. Asphaltenes were removed by treatment of 35 g liquid with 250 cc pentane. Both asphaltenes and resins were then analyzed for Ni, V, S and N. Viscosities were measured at 130° F. and at 160° F. with a Brookfield Micro-viscometer.

Table I summarizes the hydrogen and coke yield data for the runs of Examples 1–22 as follows:

TABLE I

| | | HYDROGEN AND COKE YIELDS | | | | |
|---|---|---|---|---|---|---|
| | | Yield, percent | | $H_2/CH_4$ | | Hours |
| Example | Treating Solution | Coke | $H_2$ | (moles) | Asphaltenes[a] | On Stream |
| 1 to 3 | $H_2O$ | 0.5 | 0.07 | 1.1 | 15.7% | 18.8 |
| 4 to 6 | $7.5MNH_4OH$ | | | | | |
| 7 | $H_2O$ | 0.5 | 0.10 | 1.1 | 16.9% | 12.8 |
| 8 and 9 | 0.13% S= | 0.5 | 0.06 | 1.0 | 15.6% | |
| 10 | 500ppm Ni (II)[b] | 1.2 | 0.15 | 4.0 | 18.0% | |
| 11 to 13 | 500ppm Ni (II)[b] | 1.2 | 0.21 | 5.6 | 18.2% | 8.2 |
| 14 to 22 | 0.5% S= | 0.3 | 0.08 | 1.3 | 17.2 | >35[c] |

[a]Charge = 15.8%
[b]= Nickel added in aqueous treating solution to simulate high-metals crude.
[c]= Arbitrarily terminated; had not plugged.

The data in Table I show the major, deleterious effect of nickel-containing crude. In Examples 10 to 13 where 500 ppm nickel (as the acetate) was present in the aqueous treating solution, hydrogen yield, the amount of coke and the asphaltene content of the reaction effluent increased markedly. When 0.1–0.5% sulfur present as either $Na_2S$ or $(NH_4)_2S$ was present instead of the aqueous feed, the amount of coke produced was at a minimum (Examples 14 to 22).

The data set forth in Table II below show that the added sulfide was not incorporated into the crude product (compare Examples 8 to 10 and 14 to 22 with 1 to 7):

TABLE II

| | | PRODUCT QUALITY | | | | | |
|---|---|---|---|---|---|---|---|
| | Treating | Percent Removal | | | | Average Viscosity, cps | |
| Example | Solution | Ni | V | S | N | 130° F. | 160° F. |
| Charge | — | — | — | — | — | 2990 | — |
| 1 to 3 | $H_2O$ | 23 | 15 | 5 | 10 | 680 | — |
| 4 to 6 | $7.5MNH_4OH$ | 34 | 24 | 8 | 0 | 740 | 240 |
| 7 | $H_2O$ | 16 | 4 | 2 | 10 | 210 | 70 |
| 8 and 9 | 0.13% S= | 21 | 18 | 10 | 17 | 390 | 130 |
| 10 | 500ppm Ni(II) | 56 | 49 | 33 | 31 | 1320 | 480 |
| 11 | 500ppm Ni(II) | 0 | 3 | 0 | 10 | 570 | 240 |
| 12 | 500ppm Ni(II) | 2 | 6 | 0 | 46 | 970 | 370 |
| 13 | 500ppm Ni(II) | 28 | 16 | 1 | 34 | 2000+ | 1160 |
| 14 to 22 | 0.5% S= | 26 | 27 | 16 | 12 | 700 | 250 |

It is also evident from Examples 11 to 13 that the greater amount of coke and hydrogen observed with added nickel were not merely a function of higher conversion levels, as viscosities deteriorated significantly with time on stream as nickel built up on the reactor coke.

EXAMPLE 23

Additional runs of the type reported in Examples 1–22 were carried out utilizing the same charge stock with similar results. When the treating phase contained only water or ammonium hydroxide, coke blocked the reactor after 19 hours on stream. When 1000 ppm Ni was present in the treating phase, blocking occurred after only 8 hours. When the treating phase contained 0.5% sulfur (as $Na_2S$) blockage had not occurred after 27 hours on stream. In another run treatment with 0.4% sulfur as $Na_2S$ yielded a product which contained 3.57% S, compared with 3.94% S in the feed, while about 20% of the Ni and V were removed from the crude.

What is claimed is:

1. In a process for visbreaking crude and resid feeds containing a quantity of metal values promoting the significant formation of coke, the improvement which comprises carrying out the visbreaking with an effective amount of at least one inorganic sulfide of an alkali metal sulfide, an alkaline earth metal sulfide, hydrogen sulfide or ammonium sulfide admixed with said feed to suppress coke formation.

2. The process of claim 1 wherein the amount of sulfide is about 0.05 to 5% S proportioned to a transition metal value represented by a nickel level of 50 to 2000 ppm.

3. The process of claim 2 wherein the visbreaking is conducted in the presence of steam supplied at 100-2000 psig.

4. The process of claim 1 wherein the sulfide is sodium sulfide.

5. The process of claim 1 wherein the sulfide is hydrogen sulfide.

6. The process of claim 1 wherein the sulfide is ammonium sulfide.

7. A process for the treatment of heavy crudes and resids comprising transition metal values, to reduce viscosity and pour point, including a visbreaking operation wherein the charge stock is admixed with an effective amount of an inorganic sulfide of an alkali metal sulfide, an alkaline earth metal sulfide, hydrogen sulfide or ammonium sulfide to suppress coking during said visbreaking operation.

* * * * *